US006900772B2

(12) United States Patent
Pulver

(10) Patent No.: US 6,900,772 B2
(45) Date of Patent: May 31, 2005

(54) SYSTEMS AND METHODS FOR WIRELESS TELECOMMUNICATIONS

(76) Inventor: Fred Pulver, 70 Eatons Neck Rd., Northpoint, NY (US) 11768

( * ) Notice: Subject to any disclaimer, the term of this patent is extended or adjusted under 35 U.S.C. 154(b) by 0 days.

(21) Appl. No.: 10/737,878

(22) Filed: Dec. 18, 2003

(65) Prior Publication Data

US 2004/0160372 A1 Aug. 19, 2004

Related U.S. Application Data

(60) Provisional application No. 60/434,411, filed on Dec. 19, 2002.

(51) Int. Cl.[7] ..... H01Q 1/42; H01Q 1/36

(52) U.S. Cl. ..... 343/789; 343/895

(58) Field of Search ..... 343/789, 895, 343/702, 700 MS; H01Q 1/42, 1/36

(56) References Cited

U.S. PATENT DOCUMENTS 1,219 A * 7/1839 Miller ..... 57/295
3,568,206 A * 3/1971 Sisson et al. ..... 343/750
4,668,956 A * 5/1987 Mahmad ..... 343/789
5,874,924 A * 2/1999 Csongor et al. ..... 343/797
6,095,820 A 8/2000 Luxon et al. ..... 343/702
6,317,097 B1 11/2001 Smith ..... 343/789

OTHER PUBLICATIONS

Copy of International Search Report Dated Aug. 27, 2004.

* cited by examiner

*Primary Examiner*—Hoanganh Le
(74) *Attorney, Agent, or Firm*—Michael D. Bednarek; Shaw Pittman LLP

(57) ABSTRACT

An antenna having an antenna cup and a helical element mounted in the antenna cup. The antenna cup has a side wall extending from a base thereof towards an open end thereof, the side wall having a plurality of slots formed therein, a first set of the slots being arranged parallel to a longitudinal axis of the helical element and a second set of the slots being arranged perpendicular to the longitudinal axis of the helical element, the first set of slots being arranged to surround an upper portion of the helical element and the second set of slots being arranged to surround a lower portion of the helical element. The slots present a high impedance wall to surface currents and thereby significantly reduce side lobe radiation. Such an antenna is particular useful in antenna co-location applications, such as cellular telephone and Wi-Fi applications.

24 Claims, 11 Drawing Sheets

SYSTEMS AND METHODS FOR WIRELESS TELECOMMUNICATIONS

This application claims the benefit of U.S. Provisional Application No. 60/434,411, filed Dec. 19, 2002, which is herein incorporated by reference in its entirety.

BACKGROUND

1. Field of the Invention

Embodiments of the present invention relate to telecommunications systems. More particularly, embodiments of the present invention relate to systems and methods for wireless telecommunications.

2. Background of the Invention

It is know that when attempting to co-locate multiple antennas, such a cellular telephone antennas, radio frequency problems are often encountered. For example, receiver sensitivity may be degraded due to a transmission signal from an adjacent transmitting antenna migrating into a nearby receiving antenna, and thereby causing internal spurious inter-modulation products to be generated. When a nearby transmitting signal migrates into another transmitting signal, "backward modulation" products can be retransmitted and can cause interference to reception of weaker signals on the same frequency. Additional problems impacting receiver sensitivity arise when the broadband noise of a transmitting signal falls within the pass band of a nearby receiver, or when the ultimate selectivity of a receiver is degraded by the reception of a nearby transmitting antenna. Another problem that exists is the inability to reuse frequencies in a typical wireless local area network such as one in accordance with IEEE 802.11 specifications. If a typical wireless node operates on a segment of available spectrum, in order to reuse the same spectrum at the same time, the energy from each node must not interfere with one another. This can be accomplished by having separate nodes with co-located low side and back lobe antennas pointing in unique directions.

Conditions may not always be conducive for degradation to occur. As an example, if in a digital system, such as GSM, the transmitting time slot of a cell phone does not occur in the same receiving time slot of a nearby cell phone, or if the cell phones are in a moderate signal strength area whereby the transmitting power output is reduced and the received signal strengths are high, there may not be any apparent degradation.

However, as the number of co-located antennas (e.g., for cell phones) increases, the likelihood of degradation increases, because there is a greater chance that time slot selection will not be optimum, such that the transmitting time slots of one cell phone will occur during the same time as a nearby receiving cell phone's time slots. If a system's use is not limited to high signal strength locations within a cellular coverage area, degradation will be more likely to occur. As an example, if the system is located in an area further from a cell site, the cell phone will transmit with high power, while the receive signal strength will be low. Under these conditions, receiver sensitivity degradation or spurious signals generation may prevent communications.

While there are arrangements for more effectively co-locating multiple cell phones, each has disadvantages. For standard cell phones or cell phone modules operating in accordance with a GSM-type system, there is a single antenna port that is switched between transmit and receive. In this type of system, co-locating cell phones through the use of passive combiners is possible, but may not provide the isolation needed to operate degradation free, and can create greater than 3 dB loss every time the number of cell phones is doubled.

If diplexers are used to separate a common receive antenna from individual transmitter antennas and filter the transmitters broad-band noise, backward transmitter intermodulation problem will still occur in a typical installation. This partial solution is costly in terms of price and transmit signal loss.

In view of the foregoing, it can be appreciated that a substantial need exists for systems and methods that can advantageously provide for improved wireless telecommunications.

BRIEF SUMMARY OF THE INVENTION

The present invention provides improved systems and methods for providing for the possibility of co-locating separate antennas or antennas organized in an antenna array. Using a unique antenna configuration, the present invention significantly reduces the possibility of receiver-side degradation, and allows for reuse of frequencies by controlling side lobe energy from respective antennas such that increased antenna isolation can be realized.

In accordance with an embodiment of the present invention, an antenna is provided that comprises an antenna cup and a helical driven element mounted therein such that a longitudinal axis of the helical driven element is arranged to be substantially centered within the antenna cup, the antenna cup having a side wall that encircles the helical driven element and is at least as high as a top end of an upper portion of the helical driven element, the side wall of the antenna cup having a plurality of slots formed therein, at least some of the slots being arranged to be parallel to the longitudinal axis of the helical driven element and at least some other of the slots being arranged to be perpendicular to the longitudinal axis of the helical driven element.

The surfaces of the slots provide a high impedance "wall" to surface currents traveling along interior surfaces of the antenna cup, thereby effectively reducing side lobe radiated energy.

In a preferred embodiment, the slots arranged to be perpendicular to the longitudinal axis of the helical driven element are disposed around a lower portion of the helical driven element, and the slots arranged to be parallel to the longitudinal axis of the helical driven element are disposed around an upper portion of the helical driven element. Also, the slots preferably have a depth that corresponds to a multiple of a quarter wavelength of a frequency for which the antenna is intended to be used.

To provide an antenna that is operable over a predetermined bandwidth, the antenna of the present invention preferably includes a series of adjacent slots that are successively deeper. A shallowest one of the series of adjacent slots and a deepest one of the series of adjacent slots correspond to a quarter wavelength (or odd multiples thereof) of frequencies corresponding to edges of the band of frequencies for which the antenna is intended to be used. In one possible implementation, the antenna of the present invention is mounted in an array along with similarly-configured antennas. Such an array may be used in conjunction with one or more cellular telephone, or in Wi-Fi applications.

The antenna can be formed from a unitary piece of electrically conductive material, which is milled and/or worked into the desired configuration or, instead, can be formed from non-electrically conductive material, which is then overmolded with electrically conductive material.

The antenna and antenna arrays described herein may also find particular utility in the field of bridging cellular and wireline telephones.

These and other features and the attendant advantages of the present invention will be more fully appreciated upon reading the following detailed description in conjunction with the accompanying drawings.

DETAILED DESCRIPTION OF THE INVENTION

Figure 1:
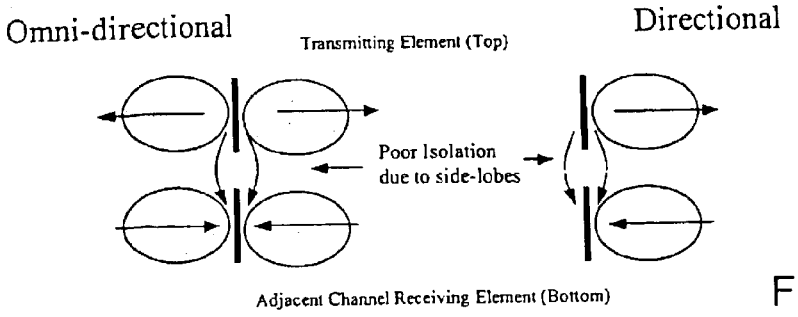
FIG. 1 shows, schematically, an antenna or antenna element array having poor isolation due to side lobes in accordance with the prior art.

Before one or more embodiments of the invention are described in detail, one skilled in the art will appreciate that the invention is not limited in its application to the details of construction, the arrangements of components, and the arrangement of steps set forth in the following detailed description or illustrated in the drawings. The invention is capable of other embodiments and of being practiced or being carried out in various ways. Also, it is to be understood that the phraseology and terminology used herein is for the purpose of description and should not be regarded as limiting.

Embodiments of systems and methods related to wireless telecommunications are described in this detailed description of the invention. For purposes of explanation, numerous specific details are set forth to provide a thorough understanding of embodiments of the present invention. One skilled in the art will appreciate, however, that embodiments of the present invention may be practiced without these specific details.

An embodiment of the present invention provides a unique antenna configuration, that can be used in applications requiring directional or omni directional (in azimuth) characteristics. The antenna is preferably composed of separate elements, with each element having significantly reduced or eliminated side lobe energy, and thus providing improved isolation from one antenna to another. In one possible implementation, each element (antenna) is connected to the antenna port of an individual cell phone or cell phone module.

FIG. 1 schematically shows known omni-directional and directional antennas or element arrays, each having a transmitting element and an adjacent channel receiving element. For example, in this case, the transmitting element is arranged towards the top and the adjacent receiving element is arranged underneath. When conventional antennas are used in these types of structures, interference often occurs. More specifically, undesirable side lobe energy "spills over" from a transmitting element to a receiving element thereby degrading receiver side performance. A system operating under such conditions is considered to have poor isolation.

Figure 2:
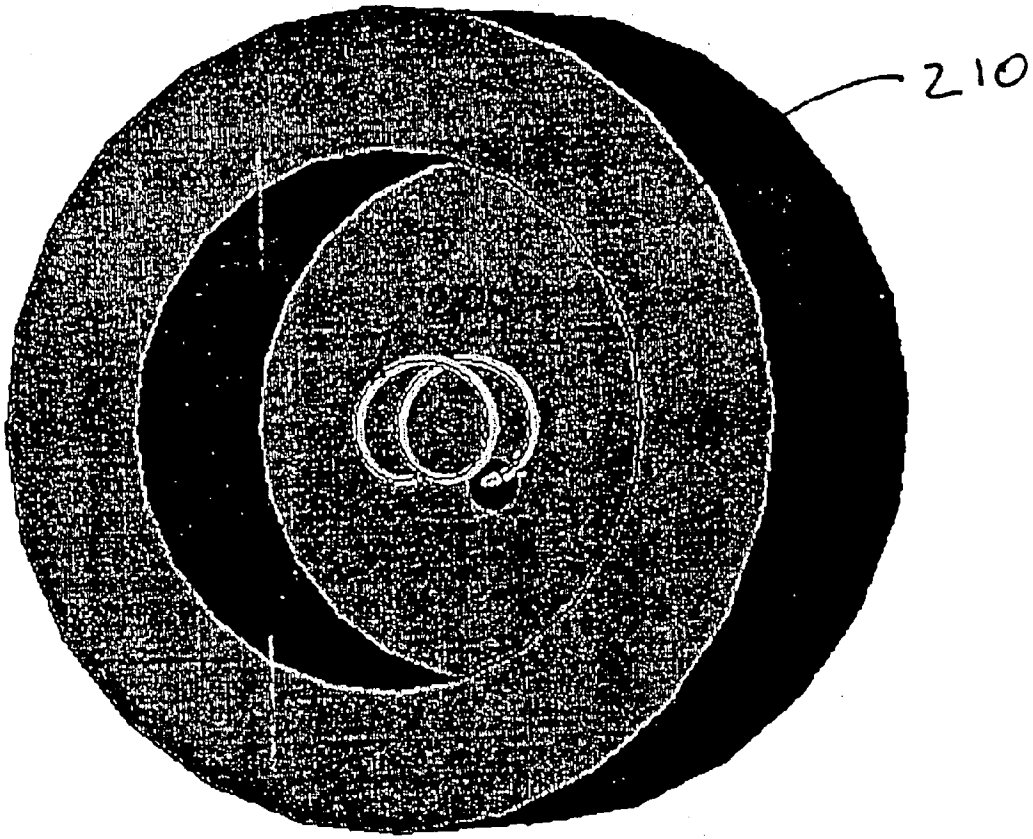
FIG. 2 is an illustration of a conventional antenna.
Figure 3:
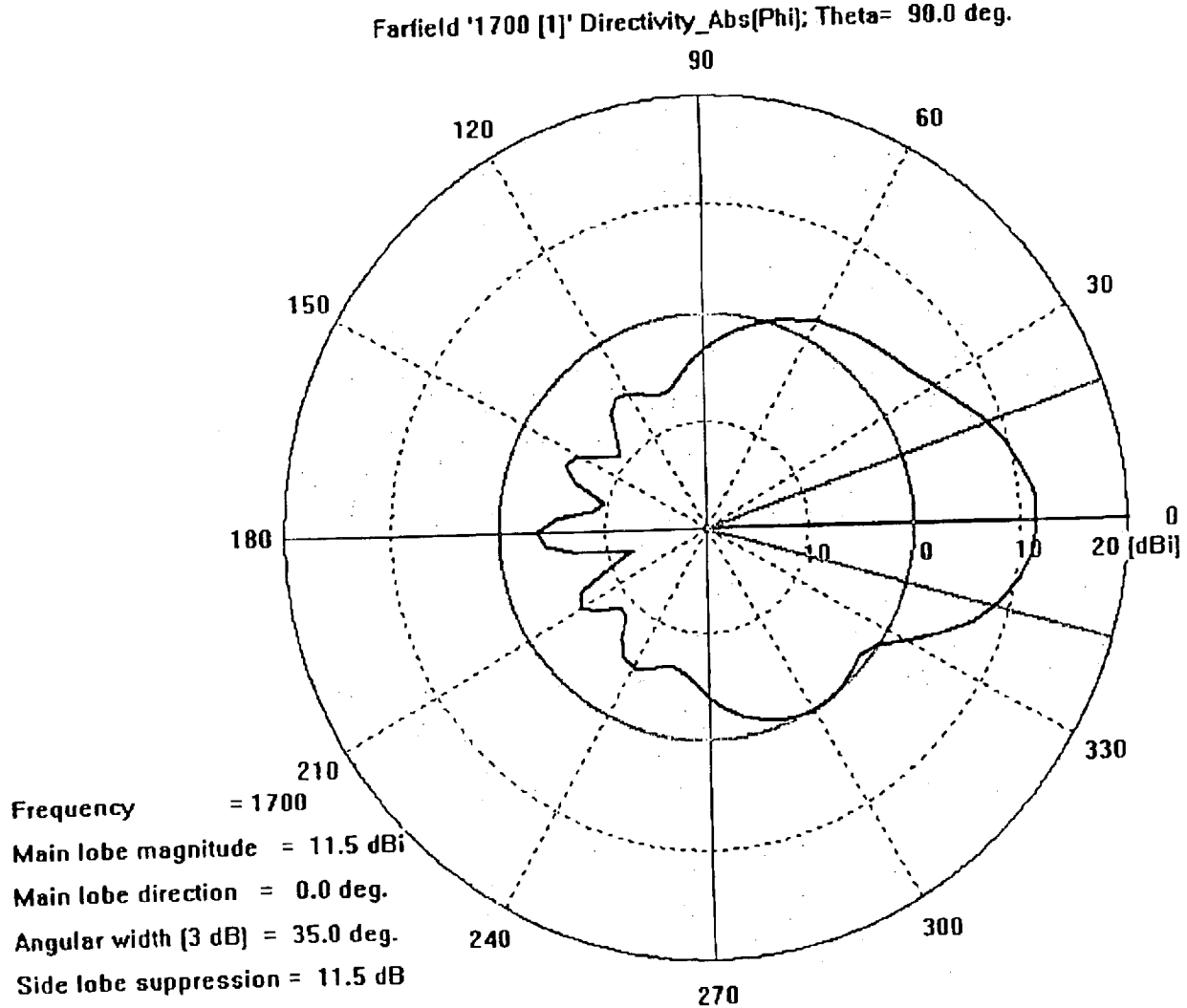
FIG. 3 shows a plot of the far field associated with the conventional antenna illustrated in FIG. 2.

FIG. 2 is an illustration of a known antenna element that would have characteristics like those mentioned above. This antenna element includes a driven helical element 200, mounted in a metallized structure resembling a cup 210. With a typical directivity of each such element of approximately 10 dB, the typical side lobe isolation will be on the order of 10 dB. Thus, the isolation between elements is on the order of 20 dB, which is typically grossly inadequate for embodiments of a system to be described later herein. FIG. 3 shows a side lobe plot associated with the known antenna element illustrated in FIG. 2.

Figure 4:
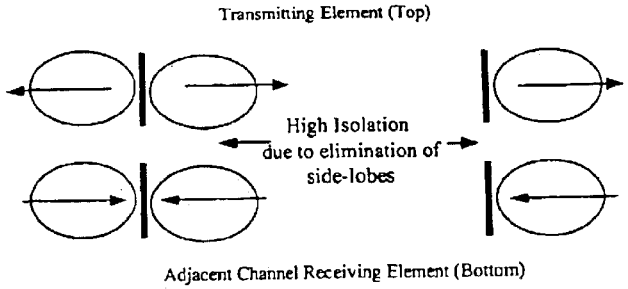
FIG. 4 shows, schematically, an antenna or antenna element array in accordance with an embodiment of the present invention.

FIG. 4 shows omni-directional and directional antennas or element arrays in accordance with an embodiment of the present invention, in which each omni-directional and directional antenna or element array has a transmitting element and an adjacent channel receiving element. Embodiments of the present invention provide significant isolation by effectively reducing or eliminating side-lobe energy.

For directional antennas or element arrays, according to an embodiment of the present invention, one type of antenna encompasses antenna elements that have circularly polarized 2 turn helixes mounted within a cup. Each element can be for an individual cell phone, and in an particular embodiment, the elements are spaced approximately 4 wavelengths away from each other. Many other implementations are possible. For example, driven elements, such as patch elements, other than helixes, may be employed.

In accordance with antenna embodiments of the present invention, the side lobes are reduced to <−30 dB with a typical isolation between elements of 60–70 dB. This allows co-sited cellular operation with minimal or no degradation, and typically without the need for lossy combiners or further costly filtering.

Figure 5:
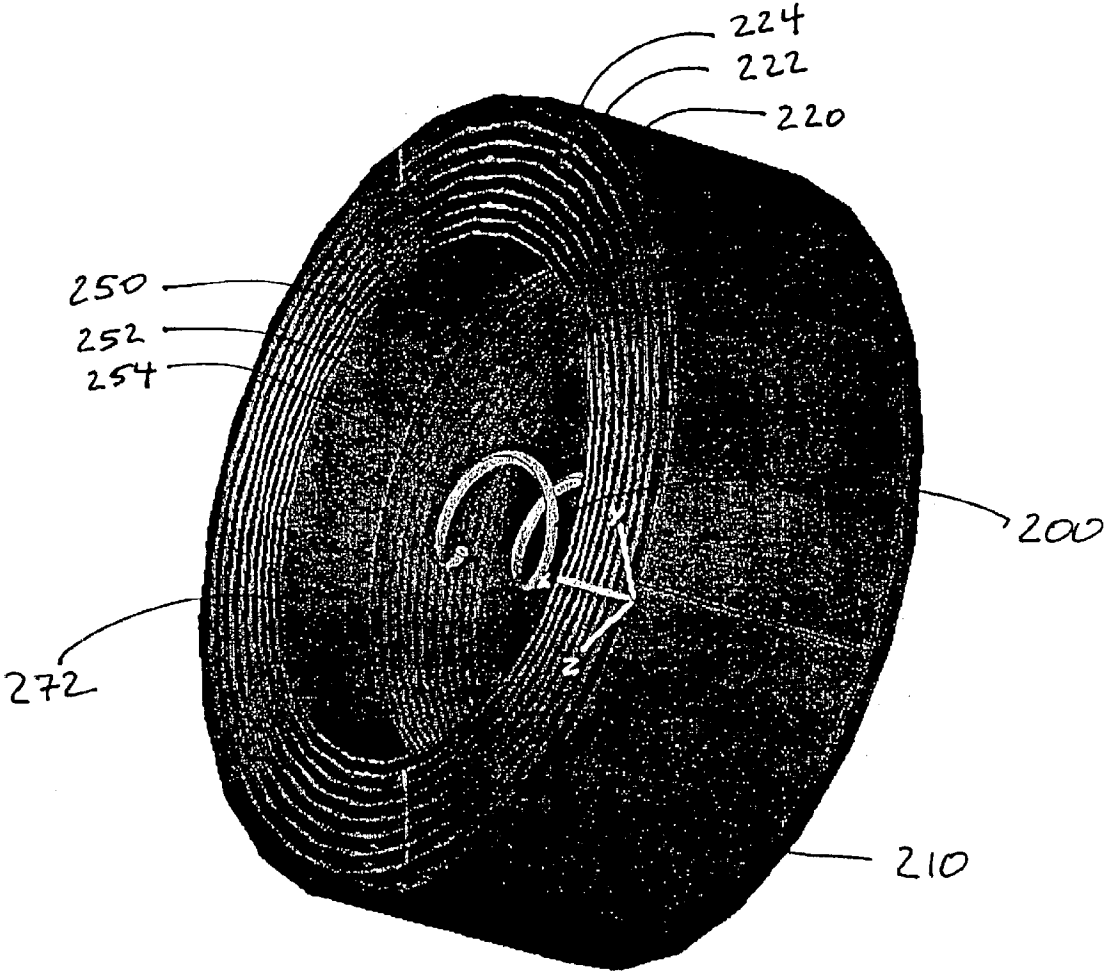
FIG. 5 is perspective view of an antenna in accordance with an embodiment of the present invention.

FIG. 5 is an illustration of an antenna element in accordance with an embodiment of the present invention. The antenna element in accordance with the present invention provides a high impedance "wall" around each helix 200 with the use of multiple circular shorted ¼ wave rings or slots (220, 222, 224, . . . , 250, 252, 254) cut into the surfaces of cup 210 to reduce or prevent surface currents from re-radiating energy from one helix to another.

In the omni-directional azimuth case, a similar high impedance "wall" is set up by positioning a barrier between the ends of collinear elements composed of similar shorted ¼ wavelength stubs cut into the barrier reducing coupling between the ends of each element and provide isolation of 60–70 dB.

Figure 6:
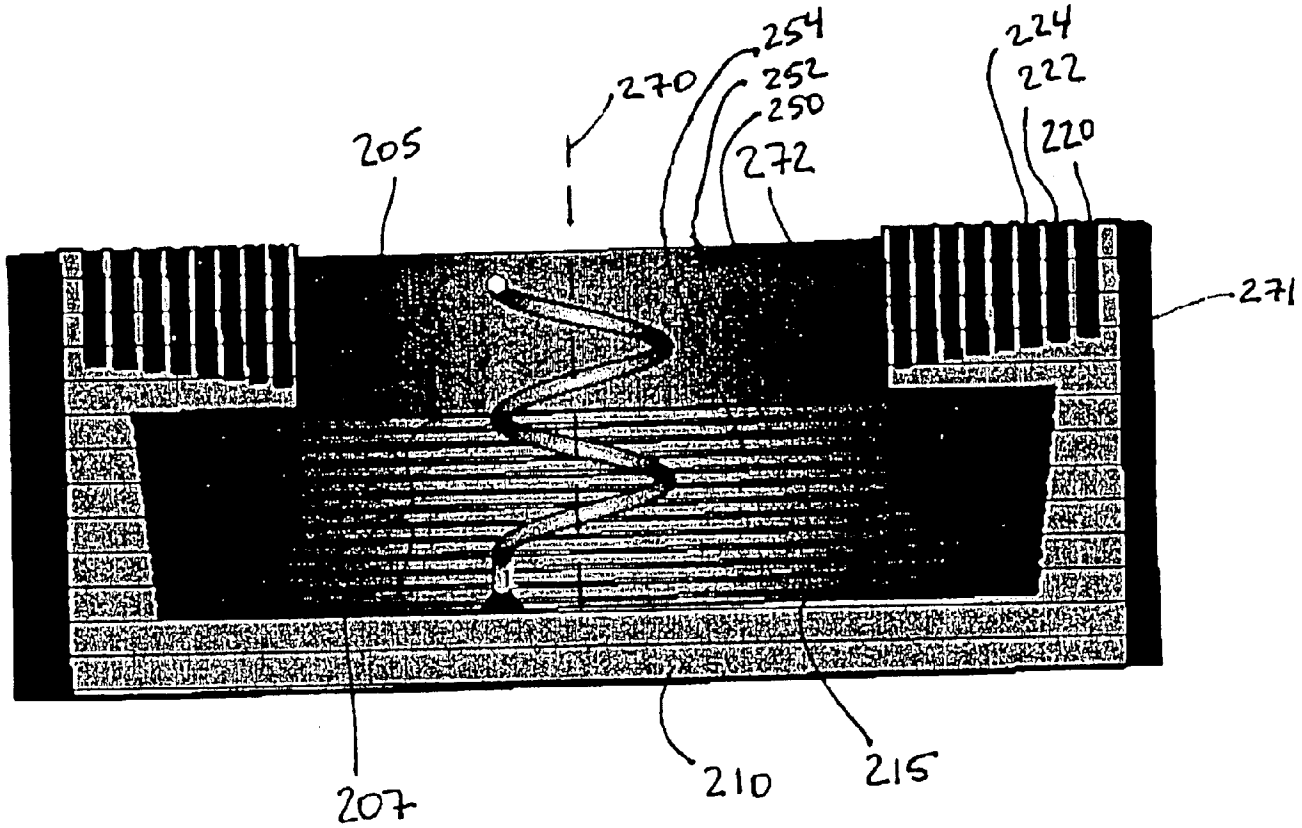
FIG. 6 depicts a cross sectional view of the antenna of FIG. 5.

FIG. 6 shows a cross sectional view of the antenna element illustrated in FIG. 5. In a preferred embodiment there are two set of slots surrounding upper 205 and lower 207 portions of helical element 200. Around upper portion 205 are cut slots 220, 222, 224 that extend parallel to a longitudinal axis 270 of helical element 200. These slots (220, 222, 224, . . . ) are preferably cut ¼ wavelength deep or any multiple of ½ wavelength (WL) plus ¼ WL. In addition, each of the individual slots 220, 222, 224, . . . , is cut successively deeper when moving from a periphery 271 of cup 210 towards an inner annular surface 272. The cuts are provided in this fashion in order to obtain the desired RF characteristics across a predetermined band. In this case, for DCS/PCS band of approximately 1700 to 2000 MHz, the shallowest cut or slot is approximately 37 mm, and the deepest cut or slot is approximately 44 mm.

As can be seen in FIG. 6, slots 220, 222, 224, . . . , that surround upper portion 205 are disposed, concentrically, in a portion of a side wall of cup 200 that overhangs perpendicularly arranged slots 250, 252, 254, . . . , of cup 200.

The slots present a high impedance to surface currents that travel across them. Even greater RF improvement can be obtained as the slots become deeper, as a longer path is presented to currents that travel along the surface of the metal within the slots. It is therefore advantageous to have the slot depths ¾ WL, 1¼ WL, and so on.

FIG. 6 also shows, in similar fashion, slots 250, 252, 254, . . . , cut in a direction perpendicular to the longitudinal axis 270 of helical element 200. These slots are also preferably cut such that, when viewing from an imaginary surface extending downward from annular surface 272 toward a bottom of cup 210, deeper slots are provided towards a top of lower portion 207 and shallower slots are provided near the bottom of lower portion 207. Measured from this imaginary surface, the slots surrounding lower portion 207 extend 27 mm to 44 mm into the wall of cup 210. These dimensions are operable for frequencies of approximately 1700 to 2000 MHz. Other slot dimensions can of course be used to accommodate other frequency ranges.

Cup 200 can be made from a solid metallic blank and machined to have the features described and shown. Alternatively, cup 210 can be molded or machined from a non-conducting material and overmolded with a material that is electrically conductive.

Figure 7:
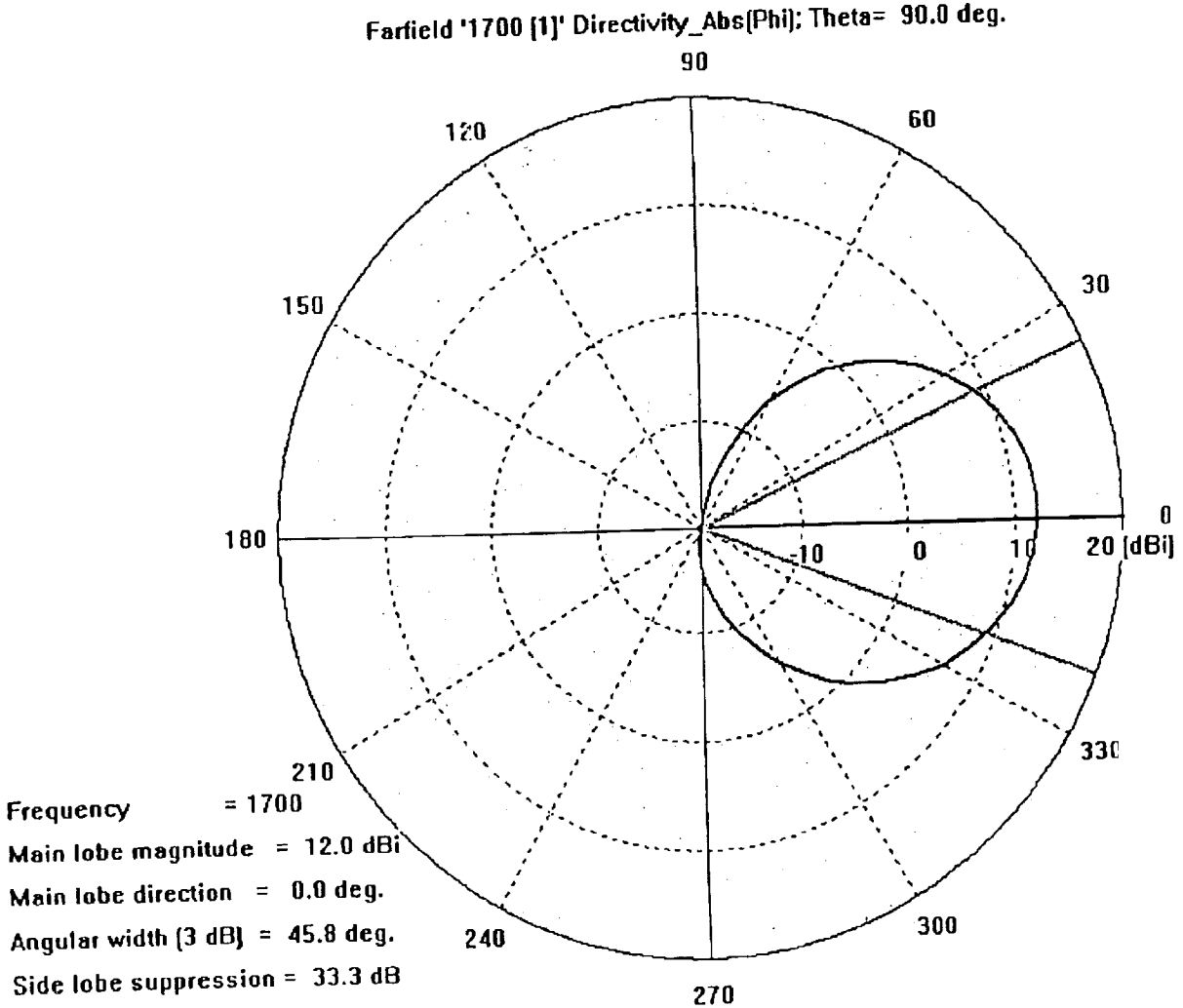
FIG. 7 shows a plot of the far filed associated with the antenna of FIGS. 5 and 6, in accordance with the present invention.

FIG. 7 shows a plot of the far field side lobe energy associated with the embodiment illustrated in FIGS. 5 and 6. As can be readily seen by inspection, the side lobes are considerably smaller in the plot of FIG. 7 compared to the plot of a conventional antenna shown in FIG. 4.

Figure 8:
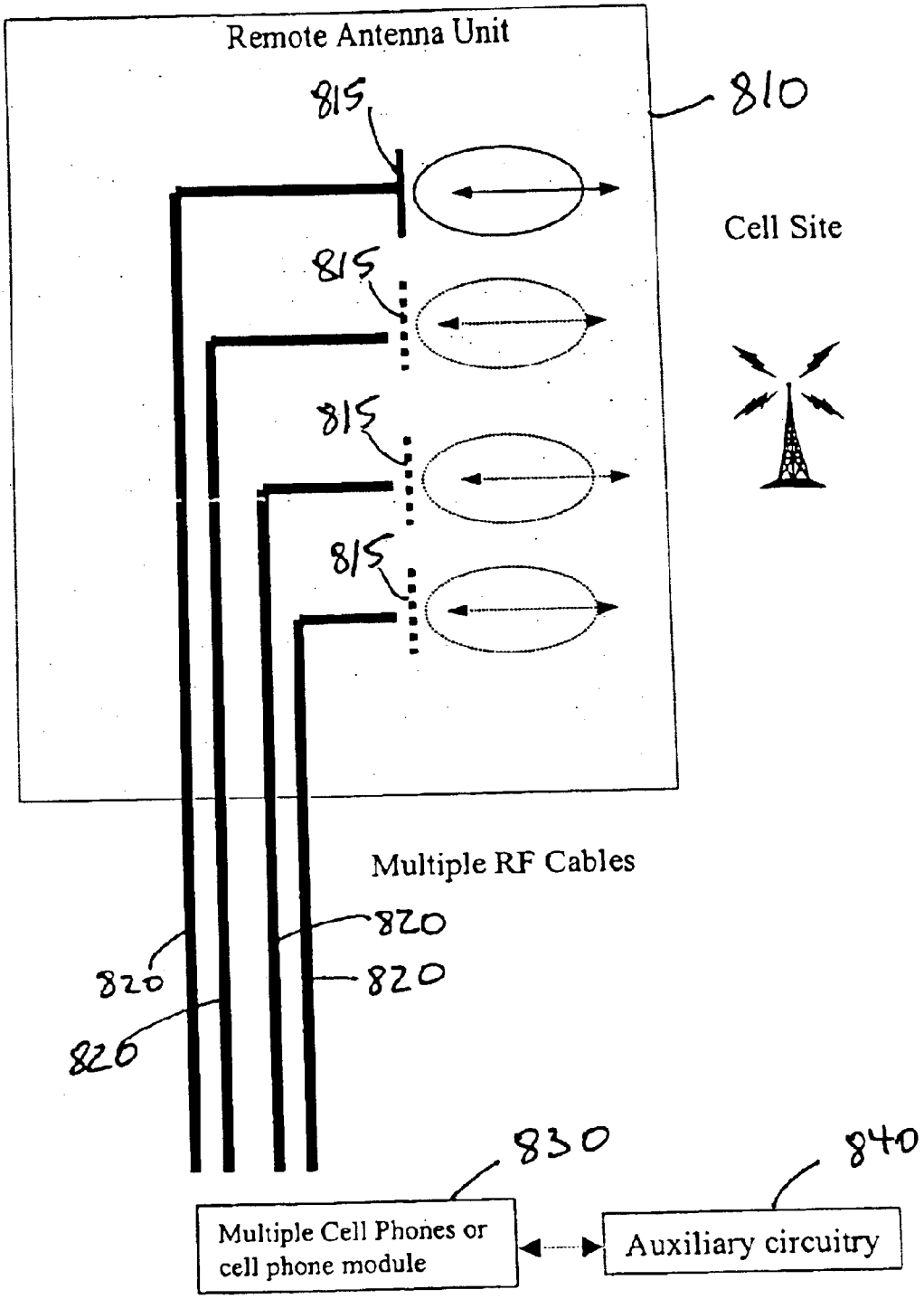
FIG. 8 shows an antenna array that serves multiple cell phones simultaneously accordance with an embodiment of the present invention.

FIG. 8 shows an application in which the antenna in accordance with the present invention finds particular utility, although the antenna of the present invention can be used in any application for which its characteristics may be useful. For example, the antenna of the present invention may find desirable use in the context of Wi-Fi. Wi-Fi is an acronym for "wireless fidelity" and is a popular term for a high-frequency wireless local area network (WLAN). Wi-Fi technology is rapidly gaining acceptance in many companies as an alternative to a wired LAN. It can also be installed for a home network. Wi-Fi is specified in the 802.11 specification from the Institute of Electrical and Electronics Engineers (IEEE) and is part of a series of wireless specifications together with 802.11, 802.11a, 802.11b, and 802.11g. These standards use the Ethernet protocol and CSMA/CA (carrier sense multiple access with collision avoidance) for path sharing. Wi-Fi is finding increased use at conventions, trade shows and other such large gatherings, where closely arranged exhibitors may want to simultaneously communicate with passers-by. The ability to segment the coverage of a WIFI node requires the use of antennas that have controlled and minimum side lobe and back lobe radiation. By segmenting coverage, frequencies can be reused and user capacity increased. The antenna configuration of the present invention is thus particularly effective for this type of application.

Referring still to a remote antenna unit 810 includes one or more antennas or antenna elements 815, preferably ones consistent with what has been described above. The antenna elements 815 are each coupled to a cell phone or a cell phone module 830 by an appropriate Radio Frequency ("RF") cable 820. Cell phones or cell phone modules 830 can also be coupled to auxiliary circuitry 840 that can, for example, couple each cell phone or cell phone module to a POTS or PBX phone.

More specifically, in accordance with an embodiment of the present invention, a local telephone system, like that shown in FIG. 8, is coupled to a public telephone network using wireless communications (e.g., cellular communications, Personal Communications Service ("PCS") communications, Global System for Mobile Communications ("GSM"), etc.) in place of wire lines. The system consists of a single or multitude of cellular telephones, telephone modules, or radios that are coupled to user phones or through a local PBX or KEY system. A KEY system encompasses a reduced features small PBX wherein all input CO lines are typically directly accessible from every user phone. Individual CO line selection buttons are typically on each user phone. A user can normally dial 9+ the calling number, or press one of the individual CO lines and access a specific line, then dial the calling number only.

As used to describe embodiments of the present invention, the term "coupled" encompasses a direct connection, an indirect connection, or a combination thereof. Two devices that are coupled can engage in direct communications, in indirect communications, or a combination thereof. Moreover, two devices that are coupled need not be in continuous communication, but can be in communication typically, periodically, intermittently, sporadically, occasionally, and so on. Further, the term "communication" is not limited to direct communication, but also includes indirect communication.

Each cell phone or module can be coupled to an analog POTS phone (i.e., a plain old telephone service phone) via circuitry that converts the cell phone interface to a standard Tip and Ring analog interface. When a number is dialed on the analog POTS phone KEY pad, the interface circuitry converts the DTMF tones activated by KEY presses to a dialing string that is sent to the cellular phone to initiate a cellular call. When a cellular telephone call is received, the interface circuitry sends a ring signal to the user phone. When the user phone is taken off book, the cell phone is issued a command by the interface circuitry to answer the call.

Embodiments of a POTS/cellular phone interface circuitry are described in U.S. patent application Ser. No. 10/042,198, filed on Jan. 11, 2002, with named inventor Fred Pulver, entitled "Systems and Methods for Communications," which is herein incorporated by reference in its entirety.

With a system having several cellular phones lines, multiple analog Tip and Ring circuits may be connected to a KEY system or PBX, or the analog lines may be converted to a digital T1, E1 or other protocol using a standard multiplexer or "Channel Bank." Known circuitry may also be used to multiplex the interface of several cell phones directly to a digital T1 type of line without converting first to an analog Tip and Ring interface.

In addition to interfacing the cellular telephone(s) to the user phone(s), the cellular phone antenna typically should be placed in a location that provides adequate signal strength. When the cellular phone antenna is remote from the cell phone, a further complication can arise from signal loss between the cell phone and the antenna. Embodiments of the present invention can advantageously provide, for example, (i) solutions to the radio frequency performance problems encountered in locating multiple cell phone antennas at the same site, and/or (ii) methods and features of connecting and remotely locating the cell phones from the user phones (e.g., where the user phones are connected to a PBX or KEY system).

Figure 9:
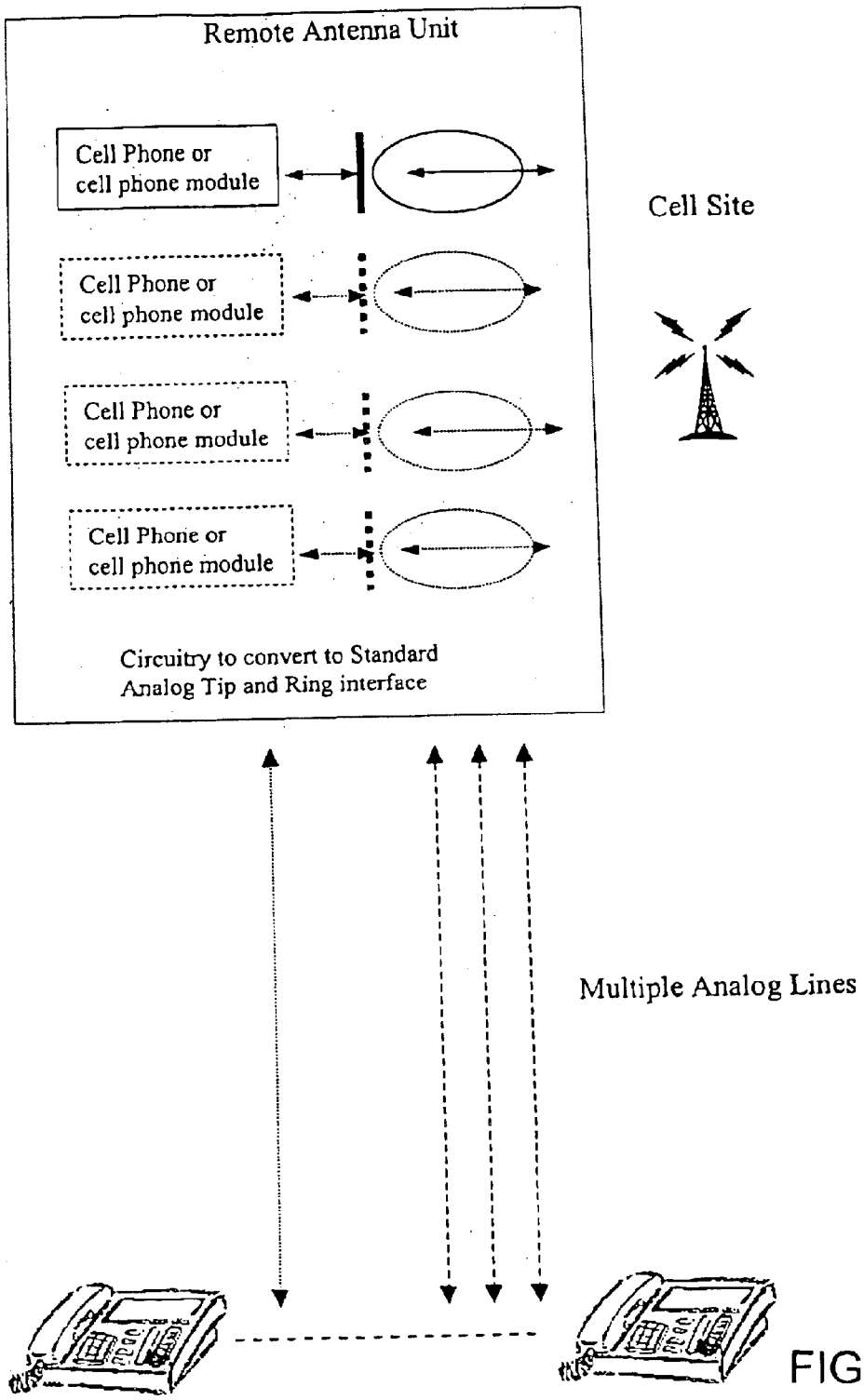
FIG. 9 shows, in accordance with an embodiment of the present invention, a system having an antenna with antenna elements that have cell phones or cell phone modules remote from the antenna.

The methods and features of remotely locating the cell phones from the user phones or PBX are shown in FIGS. 9–12. FIG. 9 shows, in accordance with an embodiment of the present invention, a system having an antenna with antenna elements that have cell phones or cell phone modules remote with the antenna. Circuitry to convert the cell phone interface to Tip and Ring and DTMF signaling is located within the antenna unit. Analog lines are connected to the individual telephones.

Figure 10:
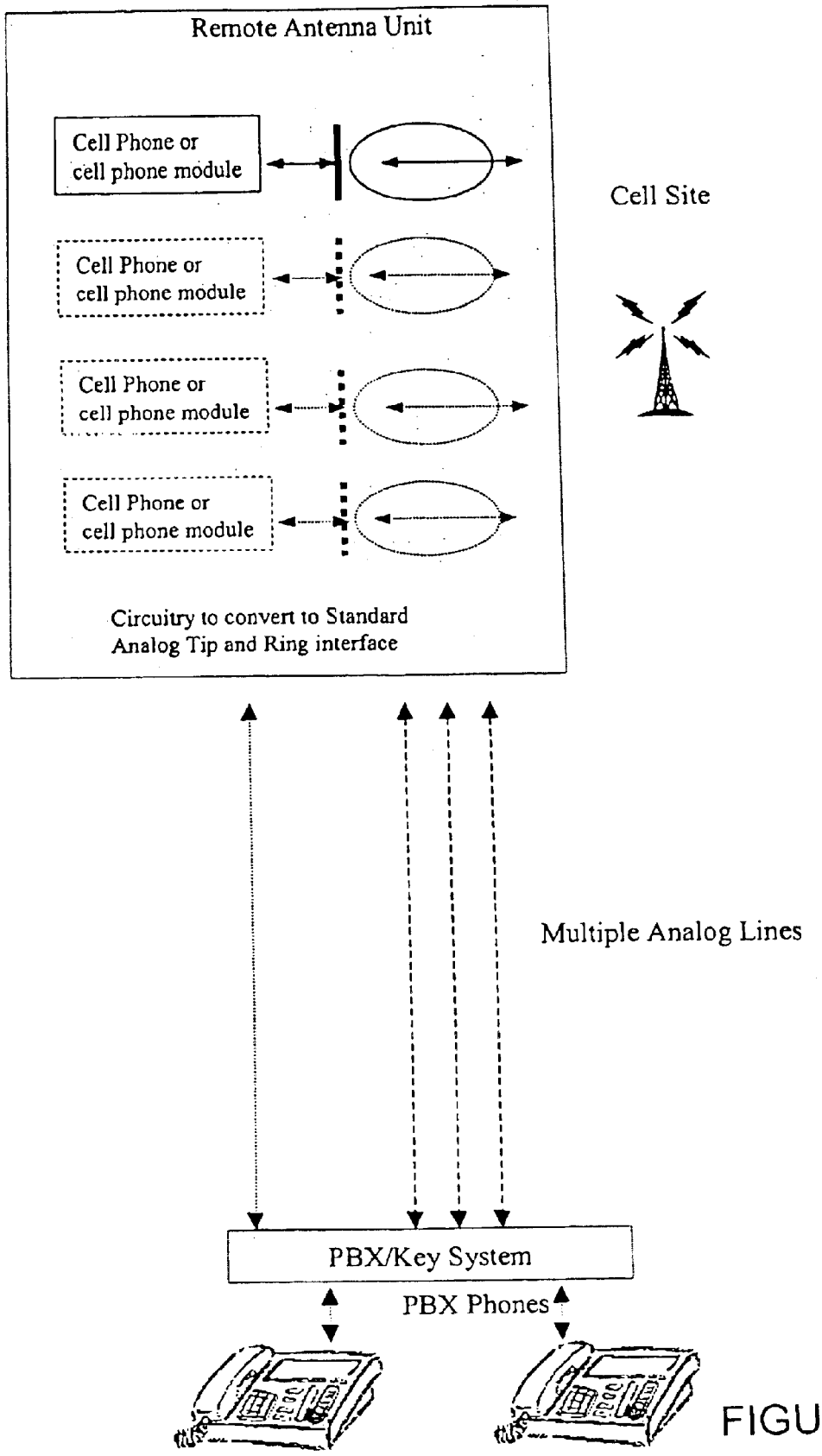
FIG. 10 shows a variation of the system illustrated in FIG. 9 such that the analog tip and ring lines are coupled to a KEY system or Private Branch eXchange ("PBX").

FIG. 10 shows a variation of the system illustrated in FIG. 9 such that the analog tip and ring lines are connected to a KEY system or PBX. The user phones are KEY system or PBX phones, giving the cellular lines the same attributes and features of a wire line PBX or KEY system.

Figure 11:
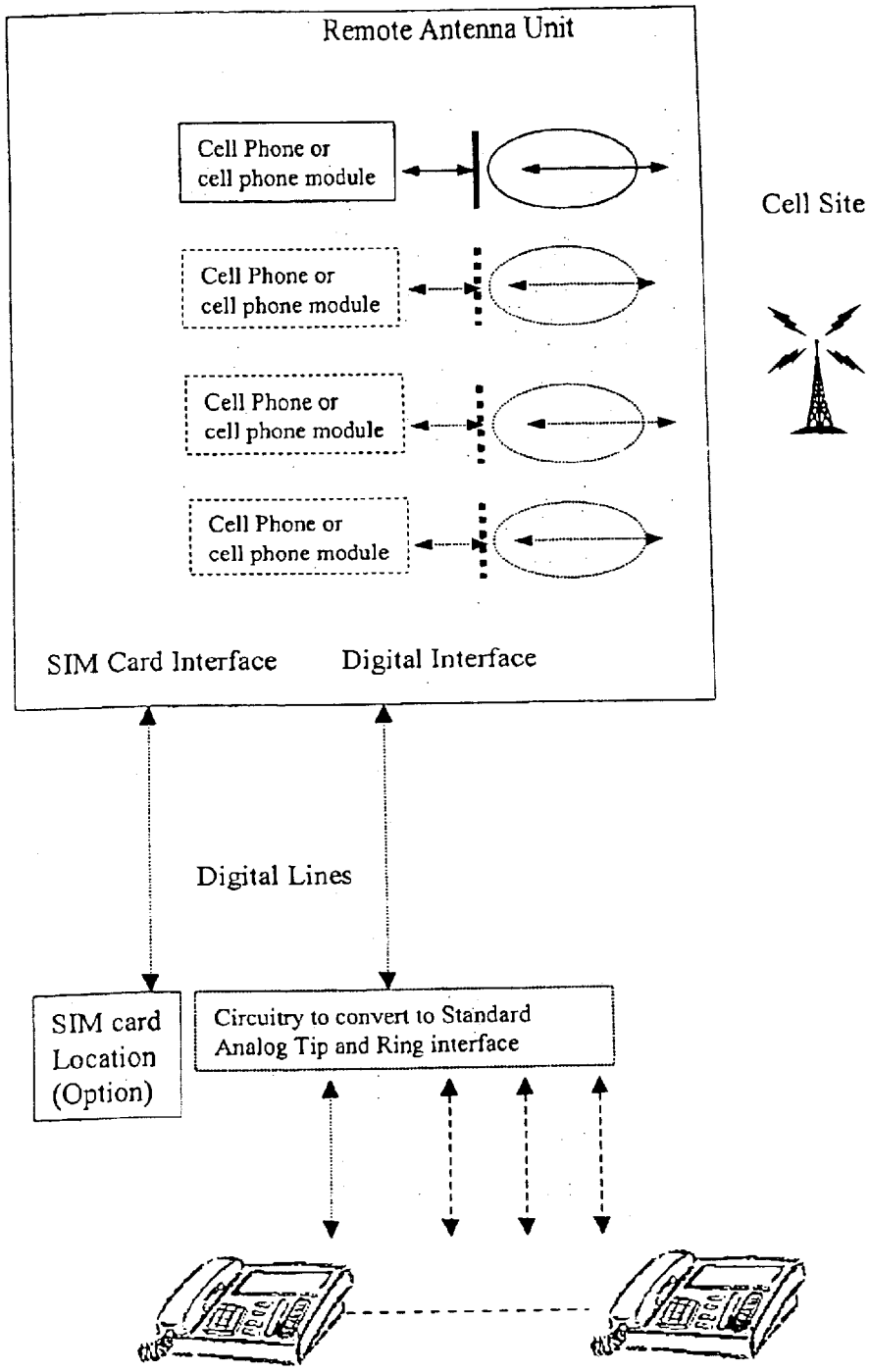
FIG. 11 shows a variation of the system illustrated in FIG. 9 such that there is a link to position the SIM card of each cell phone at the PBX end rather than at the cell phone end and a digital interface between the antenna unit and the telephone system.

FIG. 11 shows a variation of the system illustrated in FIG. 9 such that there is a link to position a Subscriber Identity Module ("SIM") card of each cell phone at the PBX end rather than at the cell phone end and a digital interface between the antenna unit and the telephone system. The link to position the SIM card of each cell phone at the PBX end rather than at the cell phone end gives the advantage of being able to conveniently install SIM cards only when needed without having to go to the remote antenna unit. In cases where the system is only used in emergency, or as a back-up system, cellular service can be easily initiated using normal mobile SIM cards. This optional remote SIM card link can be used with any of the embodiments described herein.

FIG. 11 also shows a digital interface between the antenna unit and the telephone system. The digital interface allows a more efficient connection between the antenna unit and the telephone system. With multiple lines, and certainly with a T1 or E1 system, the digital interface can consist of a standards electrical Ethernet cable that can run, for example, at 10 or 100 million bits per second (Mbps).

Protocols can be unique to the system, or can use standard signaling techniques such as Session Initiation Protocol ("SIP") with Internet protocols. The digital link may also be wireless, and use standard 802.11 or other protocols, or unique protocols for the air interface and for signaling.

Figure 12:
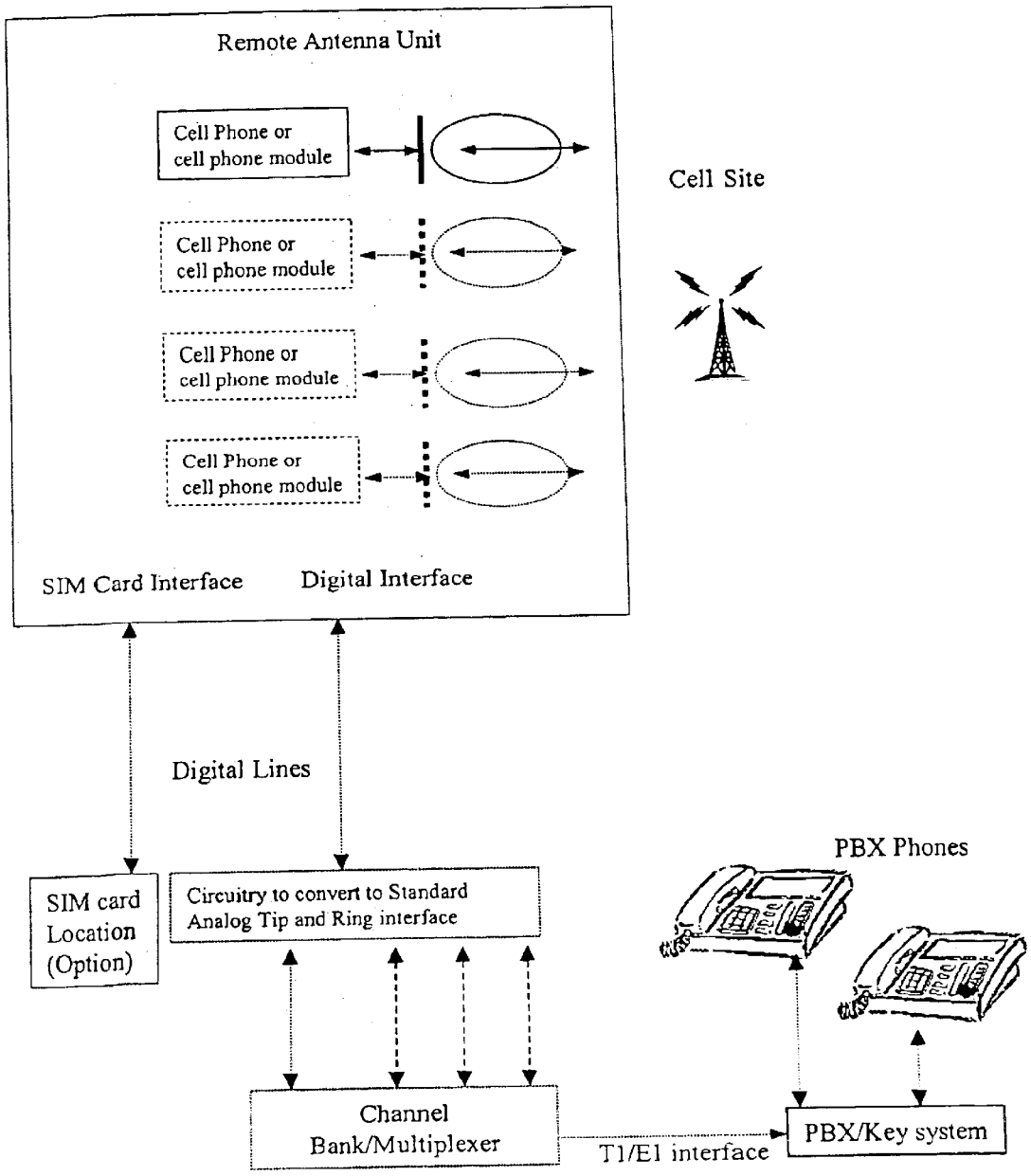
FIG. 12 shows a variation of the system illustrated in FIG. 11 such that the system includes a standard telephone multiplexer or a channel bank that converts the analog tip and ring lines to a T1 or E1 line as an input to a PBX.

FIG. 12 shows a variation of the system illustrated in FIG. 11 such that the system includes a standard telephone multiplexer or a channel bank that converts the analog tip and ring lines to a T1 or E1 line as an input to a PBX.

Various combinations of standard and dedicated protocols and hardware can be used to implement the embodiments of the systems described herein. Embodiments of the present invention can provide the ability to create an easily deployable system that has many of the attributes of a wire line telephone system but uses multiple cell phones or cell phone modules.

In this detailed description, systems and methods in accordance with embodiments of the present invention have been described with reference to specific exemplary embodiments. Accordingly, the present description and figures are to be regarded as illustrative rather than restrictive.

Embodiments of the present invention relate to data communications via one or more networks. The data communications can be carried by one or more communications channels of the one or more networks. A network can include wired communication links (e.g., coaxial cable, copper wires, optical fibers, a combination thereof, and so on), wireless communication links (e.g., satellite communication links, terrestrial wireless communication links, satellite-to-terrestrial communication links, a combination thereof, and so on), or a combination thereof. A communications link can include one or more communications channels, where a communications channel carries communications. For example, a communications link can include multiplexed communications channels, such as time division multiplexing ("TDM") channels, frequency division multiplexing ("FDM") channels, code division multiplexing ("CDM") channels, wave division multiplexing ("WDM") channels, a combination thereof, and so on.

In the foregoing detailed description, systems and methods in accordance with embodiments of the present invention have been described with reference to specific exemplary embodiments. Accordingly, the present specification and figures are to be regarded as illustrative rather than restrictive.

What is claimed is:

1. An antenna, comprising:

an antenna cup having a driven element mounted therein such that a longitudinal axis of the driven element is arranged to be substantially centered within the antenna cup, the antenna cup having a side wall that encircles the driven element and is at least as high as a top end of an upper portion of the driven element, the side wall of the antenna cup having a plurality of slots formed therein, at least some of the slots being arranged to be parallel to the longitudinal axis of the driven element and at least some other of the slots being arranged to be perpendicular to the longitudinal axis of the driven element.

2. The antenna of claim 1, wherein the slots arranged to be perpendicular to the longitudinal axis of the driven element are disposed around a lower portion of the driven element.

3. The antenna of claim 1, wherein the slots arranged to be parallel to the longitudinal axis of the driven element are disposed around an upper portion of the driven element.

4. The antenna of claim 1, wherein the slots have a depth that substantially corresponds to an odd multiple of a quarter wavelength of a frequency for which the antenna is intended to be used.

5. The antenna of claim 1, wherein a series of adjacent slots are successively deeper.

6. The antenna of claim 5, wherein a shallowest one of the series of adjacent slots and a deepest one of the series of adjacent slots correspond to edges of a band of frequencies for which the antenna is intended to be used.

7. The antenna of claim 1, wherein the antenna is mounted in an array of similarly configured antennas.

8. The antenna of claim 1, wherein the antenna is used in conjunction with a cellular telephone.

9. The antenna of claim 1, wherein the antenna is used in conjunction with a Wi-Fi application.

10. The antenna of claim 1, wherein side lobe energy is less than −30 dB.

11. The antenna of claim 10, wherein isolation between two of such antennas is at least 60 dB.

12. The antenna of claim 11, wherein the isolation is about 70 dB.

13. The antenna of claim 1, wherein the antenna is formed from a unitary piece of electrically conductive material.

14. The antenna of claim 1, wherein the antenna is formed from non-electrically conductive material, and is over-molded with electrically conductive material.

15. The antenna of claim 1, in combination with an analog telephone.

16. The antenna of claim 15, wherein the analog telephone comprises a part of at least one of a PBX and a Key system.

17. The antenna of claim 1, wherein the driven element is helical element.

18. An antenna, comprising:

an antenna cup; and a helical element mounted in the antenna cup, wherein the antenna cup comprises a side wall extending from a base thereof towards an open end thereof, the side wall having a plurality of slots formed therein, a first set of the slots being arranged parallel to a longitudinal axis of the helical element and a second set of the slots being arranged perpendicular to the longitudinal axis of the helical element, the first set of slots being arranged to surround an upper portion of the helical element and the second set of slots being arranged to surround a lower portion of the helical element.

19. The antenna of claim 18, wherein the first set of slots is arranged concentrically.

20. The antenna of claim 18, wherein at least one of the first and second sets of slots has successively increased depth.

21. The antenna of claim 18, wherein side lobe energy is less than −30 dB.

22. The antenna of claim 18, wherein isolation between two of such antennas is at least 60 dB.

23. The antenna of claim 18, mounted in an array with similarly-configured antennas.

24. An antenna, comprising:

an antenna cup and a driven element mounted inside the antenna cup, the antenna cup having a first set of slots in an upper portion of a sidewall thereof and a second set of slots in a lower portion of the sidewall; the first set of slots extending substantially parallel to an exterior annular surface of the sidewall and the second set of slots extending perpendicularly to the first set of slots, wherein the first and second set of slots have depths corresponding to a multiple of a quarter wavelength of a frequency for which the antenna is intended to be used.

* * * * *